United States Patent [19]

Pitel

[11] Patent Number: 4,463,287

[45] Date of Patent: Jul. 31, 1984

[54] FOUR LAMP MODULAR LIGHTING CONTROL

[75] Inventor: Ira J. Pitel, Morristown, N.J.

[73] Assignee: Cornell-Dubilier Corp., Wayne, N.J.

[21] Appl. No.: 309,260

[22] Filed: Oct. 7, 1981

[51] Int. Cl.[3] ..... H05B 41/392

[52] U.S. Cl. ..... 315/291; 315/195; 315/199; 315/247; 315/284; 315/294; 315/324; 315/DIG. 4

[58] Field of Search ..... 315/158, 194, 195, 199, 315/201, 208, 247, 254, 276, 284, 291, 294, 307, 308, 311, 324, DIG. 4

[56] References Cited

U.S. PATENT DOCUMENTS

| | | | |
|---|---|---|---|
| 3,878,431 | 4/1975 | Petrina | 315/199 X |
| 3,894,265 | 7/1975 | Holmes et al. | 315/194 |
| 4,197,485 | 4/1980 | Nuver | 315/291 |
| 4,207,497 | 6/1980 | Capewell et al. | 315/96 |
| 4,207,498 | 6/1980 | Spira et al. | 315/97 |

*Primary Examiner*—Eugene R. LaRoche
*Attorney, Agent, or Firm*—Ronald R. Stanley

[57] ABSTRACT

The invention is directed to a circuit and a method for efficiently controlling the output illumination level of a gas discharge lighting arrangement having four or more gas discharge lamps with multiple ballasts. Load side control of each ballast is provided by a timed interval controlled impedance, serially coupled between the particular ballast and its associated lamps. A circulating inductor, coupled in parallel with each controlled impedance, provides a current path between the power source and the lamps at least during that portion of the AC waveform when the controlled impedances are non-conducting. The invention is equally operable at both 120 volt and 277 volt AC levels without major component changes.

6 Claims, 8 Drawing Figures

FOUR LAMP MODULAR LIGHTING CONTROL

BACKGROUND OF THE INVENTION

Field of the Invention

The invention relates to circuitry for controlling the output illumination level of gas discharge lamps and more particularly to circuitry having load side control and improved lamp current waveforms utilizing a circulating inductor circuit in parallel with a controlled impedance coupled between the ballast and the gas discharge lamps.

Numerous techniques have been proposed for controlling the output illumination level of gas discharge lamps. Present-day objectives are directed to efficient energy use, and exemplifying such applications are control circuits for lamp dimming in response to selected illumination levels. One such system is illustrated in U.S. Pat. No. 4,197,485. Principal deficiencies impeding the development of this technology have been (1) dimming systems have, heretofore, generally reduced the net efficacy (lumen output/wattage input) of the lighting system; (2) the dimming circuitry, when sufficiently sophisticated to provide efficient dimming, becomes costly and burdensome. In contrast, the present invention is directed to a simple, yet efficient, method for illumination control of gas discharge lamps.

An aternative commonly employed to increase overall efficiency in dimming systems is to convert line frequency to higher frequencies. Illustrative of this technique are U.S. Pat. Nos. 4,207,497 and 4,207,498. In contrast, the present invention operates at line frequency. To enhance efficiency, the invention employs a novel configuration of load side control complemented by an inductive circulating current load to achieve circuit simplicity while maintaining an excellent power factor, illumination control of 10 to 1 dimming, excellent current crest factor and reduced lamp current and ballast loss. An attendant advantage of the circuit simplicity is the ready adaptation of the circuit to the physical housing of the conventional gas discharge lamp, an important economic and aesthetic concern.

SUMMARY OF THE INVENTION

The invention is directed to an apparatus and method of controlling the output illumination level of gas discharge lamps such as fluorescent lighting systems or the like. In particular, four lamp, dual ballast lighting fixtures may be constructed and retrofitted with the present invention. Load side control is provided by timed interval controlled impedances, serially coupled between the ballast and the lamps. An inductor is coupled in parallel relation to the controlled impedance. The inductor provides a current path between the power source and the lamps at least during that portion of the AC waveform where the controlled impedance is in a substantially non-conductive state. The novel configuration facilitates the use of conventional magnetic ballast illumination control in a plurality of ballast/lamp arrangements, in the illumination range of 10% to 100% of full intensity illumination with substantially no reduction in the cathode heating voltage supplied to the lamps. An attendant advantage of the circulating inductor configuration is a reduced blocking voltage requirement for the controlled impedance, further simplifying component requirements.

DETAILED DESCRIPTION OF THE PREFERRED EMBODIMENTS

Figure 1:
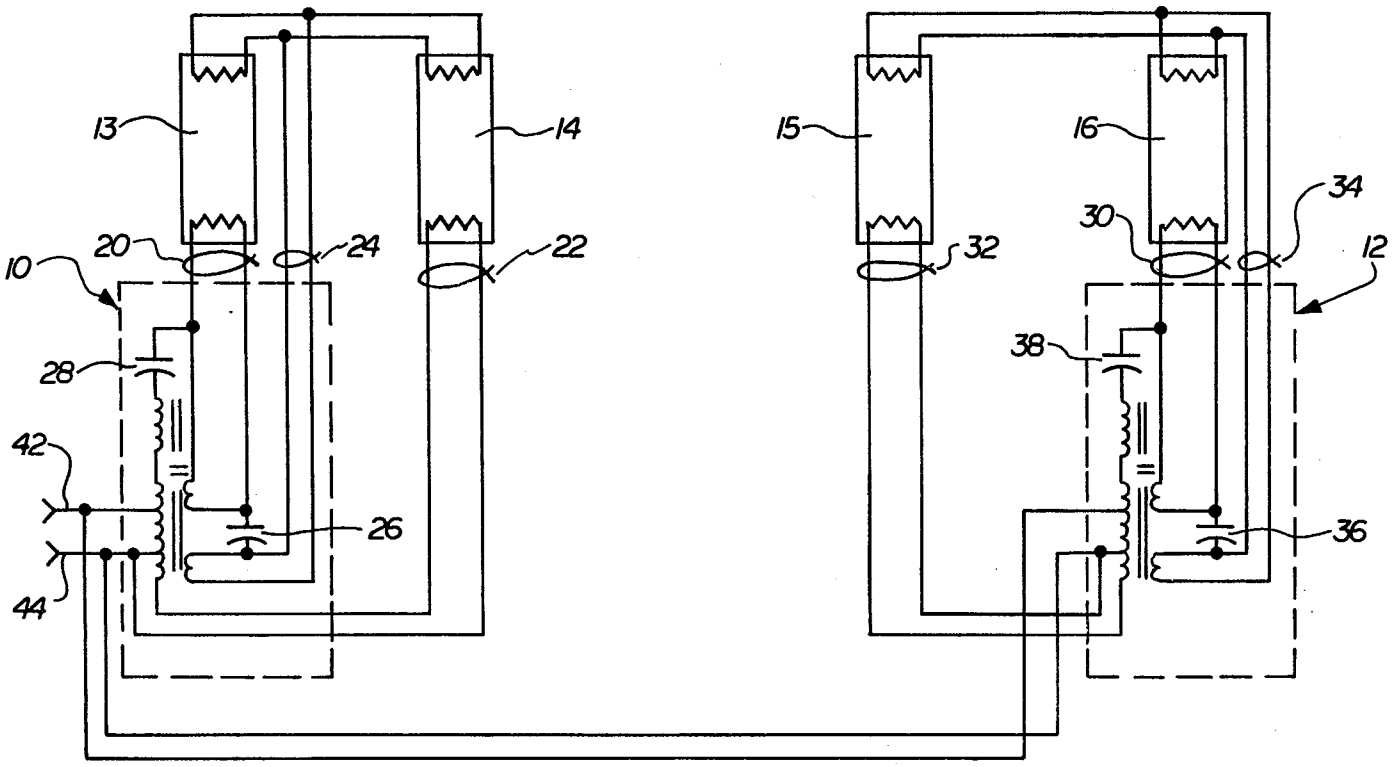
PRIOR ART FIG. 1
FIG. 1 illustrates a conventional dual magnetic ballast, four lamp fluorescent lighting system.

Referring to the drawings, FIG. 1 is a conventional four lamp fluorescent lighting installation serving as a basis for illustrating the novel characteristics of the present invention. Standard magnetic ballasts 10 and 12, which are essentially complex transformers wound on iron cores, drive the two pairs of serially connected gas discharge (fluorescent type) lamps 13,14 and 15,16. As used in FIG. 1, ballast 10 includes lead pairs 20, 22 and 24, each of which is driven from a small winding in the ballast. Ballast 10 also includes a starting capacitor 26 and a series capacitor 28 which serves to correct for power factor and provide for current limiting. In operation, the lead pairs 20, 22 and 24 provide heating current for the cathodes of lamps 13 and 14, and the power for driving the lamps in series is provided between the leads 22 and 20. Likewise, ballast 12 includes lead pairs 30, 32 and 34 as well as a starting capacitor 36 and a series capacitor 38.

Figure 2:
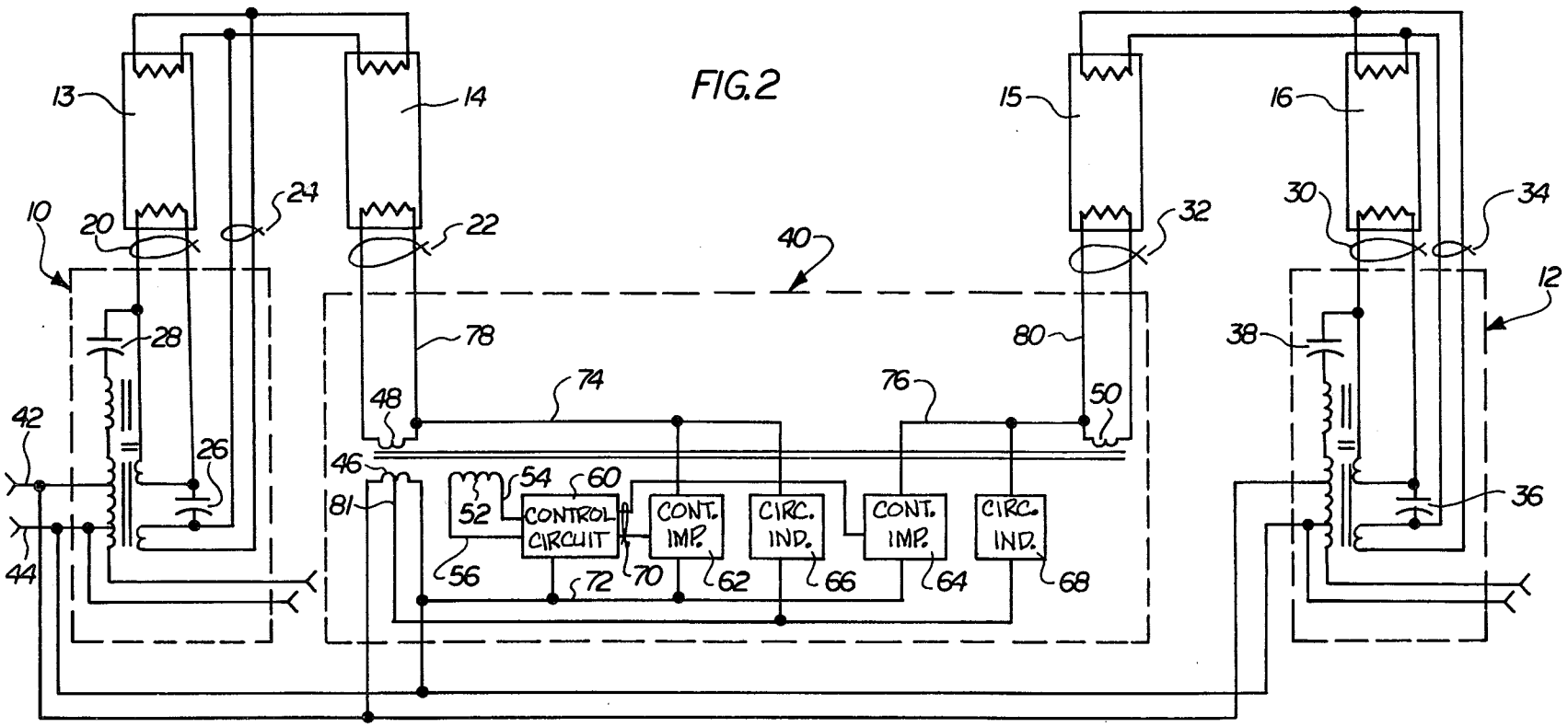
FIG. 2 is a partially schematic, partially block diagram illustration of the illumination control system of the present invention.

FIG. 2 illustrates one embodiment of the gas discharge lighting control apparatus of the present invention. To facilitate illustration, conventional fluorescent lamps are used as a specific embodiment of the gas discharge lamps, noting, however, the applicability of the invention to other gas discharge lamps including mercury vapor, sodium vapor, and metal halide.

Ballasts 10 and 12 are substantially identical to the conventional ballasts described hereinabove. A modular control unit (MLC) 40 is serially interposed between each ballast 10 and 12 and respective lamps 13, 14 and 15, 16. The connection of modular control unit 40 into the conventional circuit arrangement (FIG. 1) is accomplished by decoupling cathode leads 22 and 32 from ballasts 10 and 12 and connecting the MLC between power and the cathode leads.

The inputs of ballasts 10 and 12 are connected to AC power through leads 42 and 44. When connecting MLC 40, the input of the MLC is likewise connected to power leads 42 and 44 with the outputs connected to cathode lead pairs 22 and 32.

Energy to heat the lower cathodes of lamps 14 and 15 are coupled from leads 42 and 44 through windings 46, 48 and 50 to lead pairs 22 and 32. Windings 46 and 48, 50, therefore, preferably include a different number of turns, so that the voltage across lead pairs 22 and 32 is the same as in FIG. 1. (This voltage would typically be about 3.6 volts.) A winding 52 includes a smaller number of turns than winding 46 in order to achieve a step down of voltage. In a conventional 120 volt system, winding 52 preferably provides about 18 volts AC between output leads 54 and 56. This 18 volt signal serves as a power source for a control circuit 60, discussed hereinafter.

The modular control unit 40 broadly comprises a transformer including windings 46, 48, 50 and 52; controlled impedances 62 and 64, one for each ballast 10 and 12 having a main current conduction path coupled across the transformer; circulating inductors 66 and 68, one for each ballast coupled in parallel relationship with each of the controlled impedances and a signal related to the line voltage; and control circuit 60 providing a time duration controlled drive signal to control electrodes 70 of impedances 62 and 64. In practice, control circuit 60 is effective to drive impedances 62 and 64 into or from a conductive state during a controlled portion of each half cycle of the AC line voltage.

Controlled impedances 62 and 64 are preferably controlled switches which can provide either an open circuit or a short circuit between leads 72 and 74, 76, respectively (and therefore between terminals 44 and 78, 80), depending upon a control signal provided on leads 70 by control circuit 60. It will be appreciated that the state of controlled impedances 62 and 64 (conductive or non-conductive) determines whether lamp current flows through controlled impedances 62 and 64 or is circulated through inductors 66 and 68. When controlled impedances 62 and 64 are conductive, there exists a series circuit between the ballasts and the lamps applying operating current to the lamps. When impedances 62 and 64 are non-conductive, operating lamp current is circulated through inductors 66 and 68.

As noted above, windings 46, 48, 50 and 52 are physically constructed as a single isolation transformer with winding 46 comprising the primary. The transformer includes a voltage tap 81 on the primary winding to which one lead of each circulating inductor 66 and 68 is coupled. This permits circulating inductors 66 and 68 to be coupled to virtually and voltage up to the line voltage. For standard magnetic ballasts, the optimum tap voltage is about 90 volts. This voltage has been demonstrated to prevent lamp re-ignition when the controlled impedances are completely non-conducting. This minimizes the inductors' VA rating, yet permits full output when the controlled impedances are substantially conducted. An attendant advantage of the isolation transformer is a reduction in the blocking voltage requirements of the controlled impedances. Furthermore, it provides a means to permit the application of modular lighting control to any power main to achieve substantially identical load-side control in multiple lamp configurations.

The present application is related to U.S. patent application Ser. No. 286,770 filed July 27, 1981 for Modular Lighting Control with Circulating Inductor by the same inventive entity, the subject matter of which is incorporated herein by reference.

Figure 3:
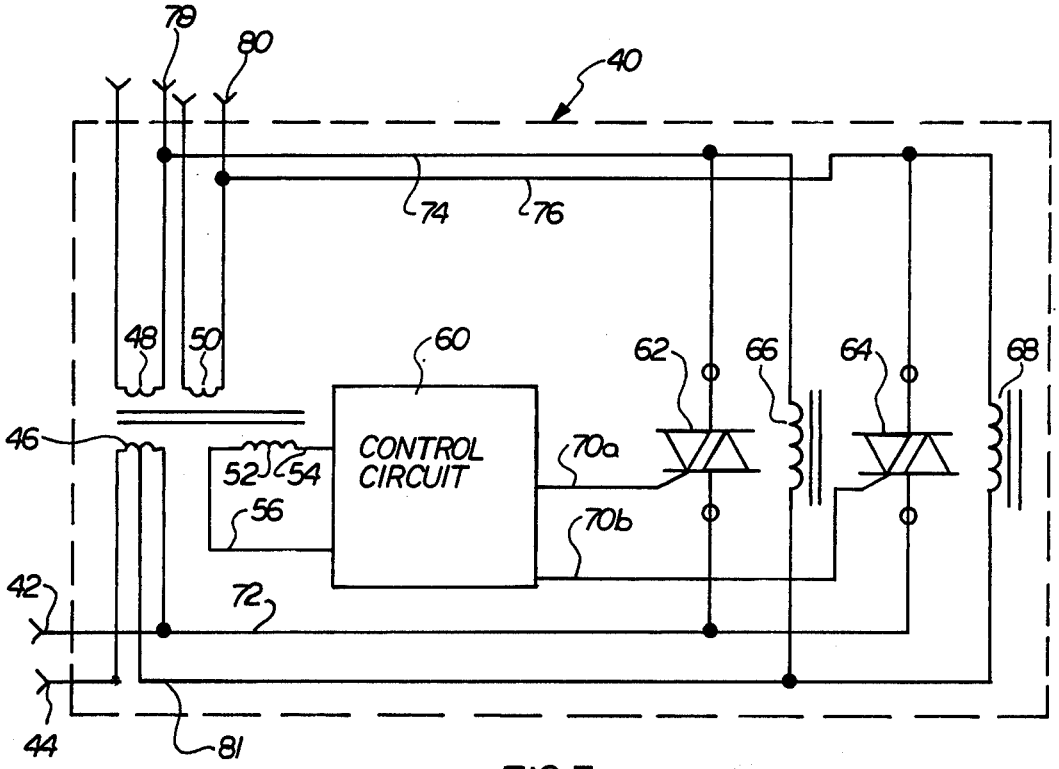
FIG. 3 is a schematic diagram of the principal components of the light control circuit of the present invention.

Referring to FIG. 3, controlled impedances 62 and 64 preferably comprise TRIACS having main current conduction paths coupled between line voltage tap 44 and the gas discharge lamps. The control or gate electrode of the TRIACS are coupled to output 70 of control circuit 60. In the absence of an activating signal at the gate, TRIACS 62 and 64 present a very high impedance between terminals 72 and 74, 76. When an activating (triggering) signal is applied at output 70, the TRIACS turn on, thereby presenting a low impedance (i.e., it becomes conductive) between terminals 72 and 74 and 76. Thereafter, the TRIACS remain conductive until the current flowing therethrough fails to exceed a predetermined extinguishing current. TRIACS conduct in both directions upon being triggered via lead 70. However, unless the trigger signal is maintained on lead 70, the TRIACS will turn off during each cycle of an AC signal applied between the main terminals, since the current flow will drop below the extinguishing current when the AC signal changes direction.

In a preferred embodiment, TRIACS 62 and 64 are, therefore, retriggered during every half cycle of the power signal. By varying the delay before retriggering occurs, it is then possible to control the proportion of each half cycle over which TRIACS 62 and 64 conduct, and thereby the overall power delivered to the lamps via leads 74 and 76.

Conventional lead type magnetic ballasts achieve high power factor by providing high primary magnetization current to compensate for the leading component of lamp current. With thyristor control on the load side of the ballast without the circulating inductor, the internal series inductor and capacitor of the ballast resonate at their natural frequency. This results in higher than normal harmonic currents and a lagging fundamental lamp current. The use of a high primary magnetization current further reduces power factor and degrades ballast performance. One means typically used to improve the input current waveform would be added capacitance at the input of the ballast. This reduces the lagging magnetization current, but leaves the higher than normal harmonic currents. Using conventional ballasts, the present invention requires substantially less input capacitance to achieve 90% power factor, typically about 4–6 microfarads. Furthermore, the invention teaches a circuit configuration having a significantly reduced magnetization current without the addition of input capacitance. In one embodiment, magnetization current is lowered by interleaving the ballast laminations.

The present invention includes inductors 66 and 68 which provide circulating currents to discharge lamps 13 and 14 and 15 and 16, respectively, at least during the period during which the TRIACS are non-conductive. Using this circuit configuration lamp current now has a path to continue flowing while the TRIACS are non-conducting. The addition of the circulating inductors reduces lamp current and ballast losses, reduces blocking voltage requirements of the TRIACS and reduces the lamp re-ignition voltage. More importantly, the addition of the circulating inductors improves the lamp current crest factor (peak to rms lamp current) increasing lamp power factor.

Figure 4:
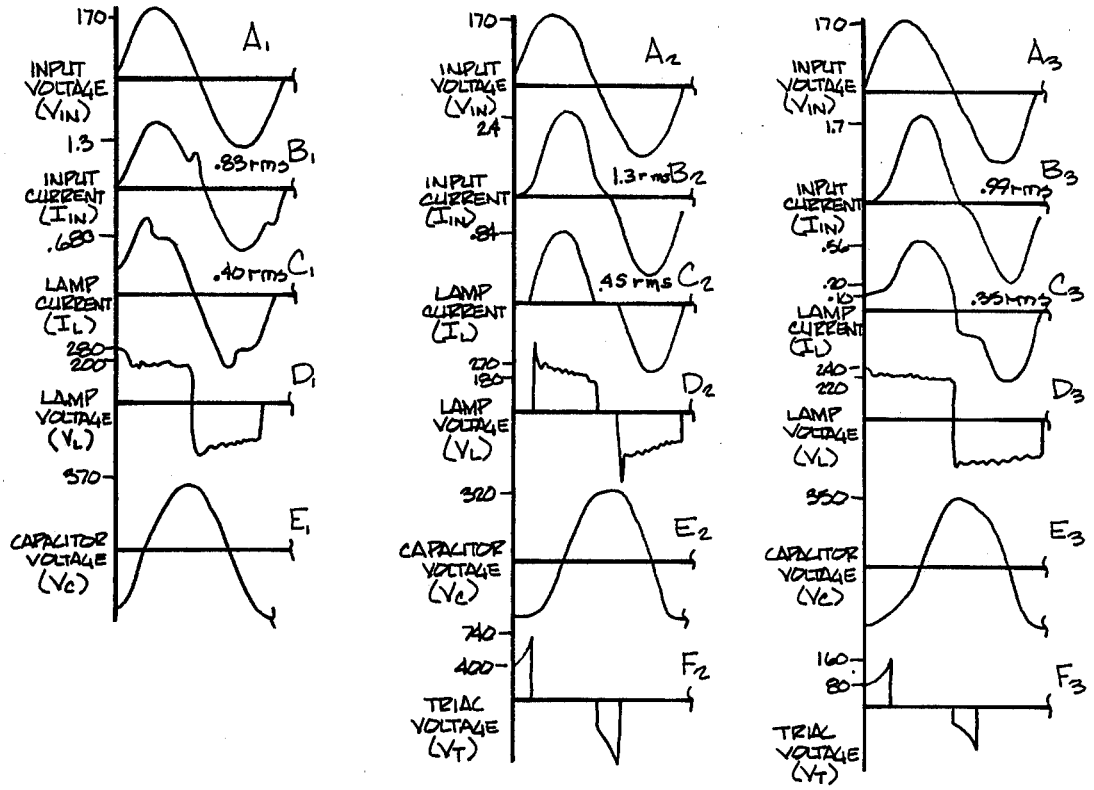
FIG. 4 is a comparison of voltage and current waveforms, at key circuit points, including the inventive circuitry and conventional lighting systems.

The salient features of the inventive circuitry are best recognized by comparing voltage and current waveforms at key points in the circuit. Accordingly, FIG. 4 illustrates voltage and current waveforms, shown as a function of time with arbitrary but comparative ordinate values, for the control circuit of the present invention. These traces are shown in comparison to the conventional fluorescent lighting circuit illustrated in FIG. 1, and also shown in comparison to the invention's control system without the circulating inductor as taught herein.

Traces $B_1$, $B_2$ and $B_3$ compare input currents for the three aforementioned circuits. Although trace $B_3$ exhibits a higher peak input current than that of the non-controlled circuit of trace $B_1$, the input current of the present invention is significantly lower than a comparable controlled circuit without such inductor, trace $B_2$.

Traces $C_1$, $C_2$ and $C_3$ compare lamp current for the three subject circuits. As illustrated in the traces, the lamp current for the present invention does not exhibit the fundamental current components which leads line voltage, trace $A_1$, in the conventional fluorescent lighting circuit. Traces $D_1$, $D_2$ and $D_3$ illustrate that lamp re-ignition voltage is lowest in the present invention. Furthermore, there is no dead band as in the case without the circulating inductor.

Referring to traces $E_1$ through $E_3$, it is noted that although the capacitor voltage is substantially identical for all three systems, the voltage waveform during the non-conducting periods of the controlled impedance for the present invention as illustrated in trace $E_3$ provides a means for capacitor voltage decay while the circuit without the circulating inductor illustrated in $E_2$ does not. This results in a substantially reduced voltage across the controlled impedance as illustrated in trace $F_3$ compared to the TRIAC voltage exhibited in trace $F_2$, whose ordinate scale is five times that used in trace $F_3$.

Figure 5:
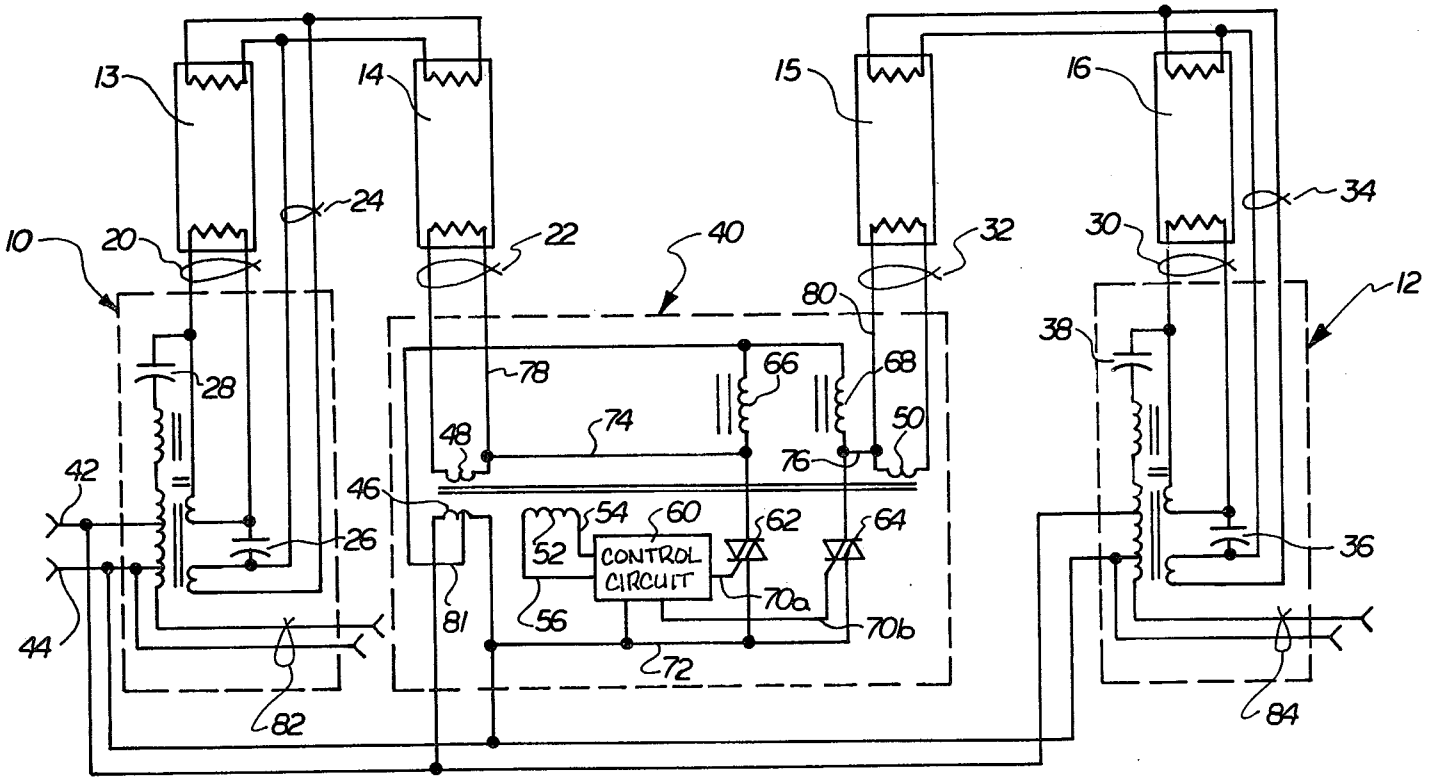
FIG. 5 illustrates, in schematic diagram format, the lighting control system of one embodiment of the present invention.

FIG. 5 illustrates the use of the present invention in the conversion of a standard 120 volt AC, fluorescent lighting system. The system includes ballasts 10 and 12, lamps 13,14 and 15,16, respectively. As noted above, lead pairs 22 and 32 are disconnected from ballasts 10 and 12 at lead pairs 82 and 84. Modular lighting control 40 is then connected into the system by joining lead pairs 22 and 32 with windings 48 and 50, respectively, and winding 46 to power leads 42 and 44. Lead pairs 82 and 84 of the ballasts are left unconnected. The return line for circulating inductors 66 and 68 is connected to a center tap on winding 46 rather than neutral line 42 of the power source.

Figure 6:
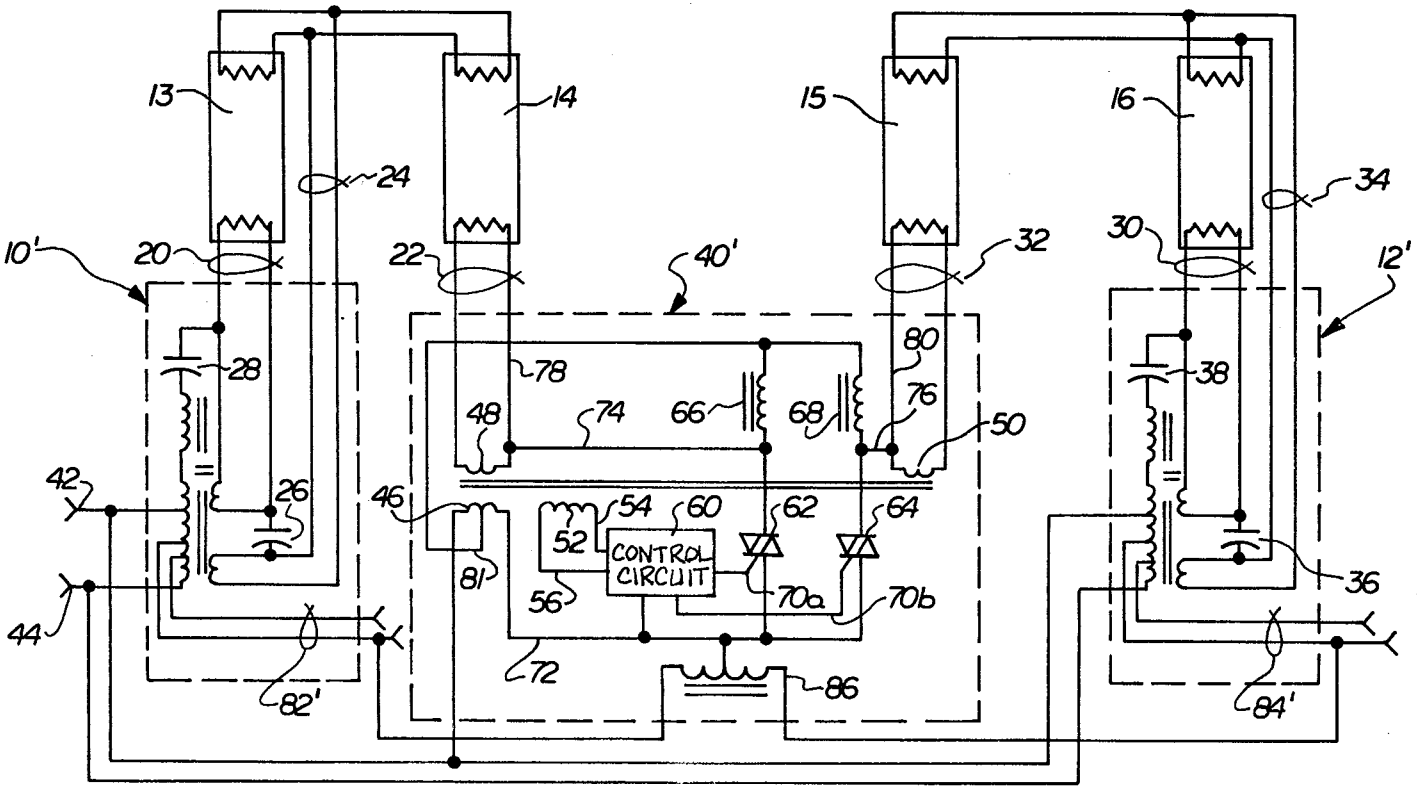
FIG. 6 illustrates, in schematic diagram format, the lighting control system of another embodiment of the present invention.

Frequently, four lamp fluorescent lighting systems are designed for operation at 277 volts AC. Modular lighting control 40 shown in FIG. 5 could be used with a 277 volt supply if the magnetics, i.e. winding 46, was greatly increased in size. In order to avoid the necessity and expense of specially designed magnetics for 277 volt AC operation, an alternate modular lighting control 40', shown in FIG. 6, may be used for either 120 volt or 277 volt operation. In 277 volt systems alternate ballasts 10' and 12' are used which include lead pairs 82' and 84' as taps on the main ballast windings. In normal operation, lead pairs 82' and 84' are connected to the lamps through lead pairs 22 and 32, respectively. As in the case of MLC 40 in FIG. 5, lead pairs 22 and 32 are connected to windings 48 and 50 when MLC 40' is used as shown in FIG. 6. One lead of main winding 46 is connected to power lead 42. The other lead of winding 46, and one terminal of each TRIAC 62 and 64, are connected to the tap of the main winding of ballasts 10' and 12' through a balancing transformer 86.

The balancing transformer is required to support the voltage difference between lead pairs 82' and 84' which may be as much as 15 volts AC. Conventional ballasts do not distinguish the two leads in each pair, one from another, and the voltages thereon may be different. Further, the actual value of the potential between lead 42 and either of lead pairs 82' or 84' can vary from 109 volts to 131 volts AC depending upon the particular manufacturer of the ballasts. Balancing transformer 86 allows for use of a common modular lighting control in 120 and 277 volt systems.

Figure 7:
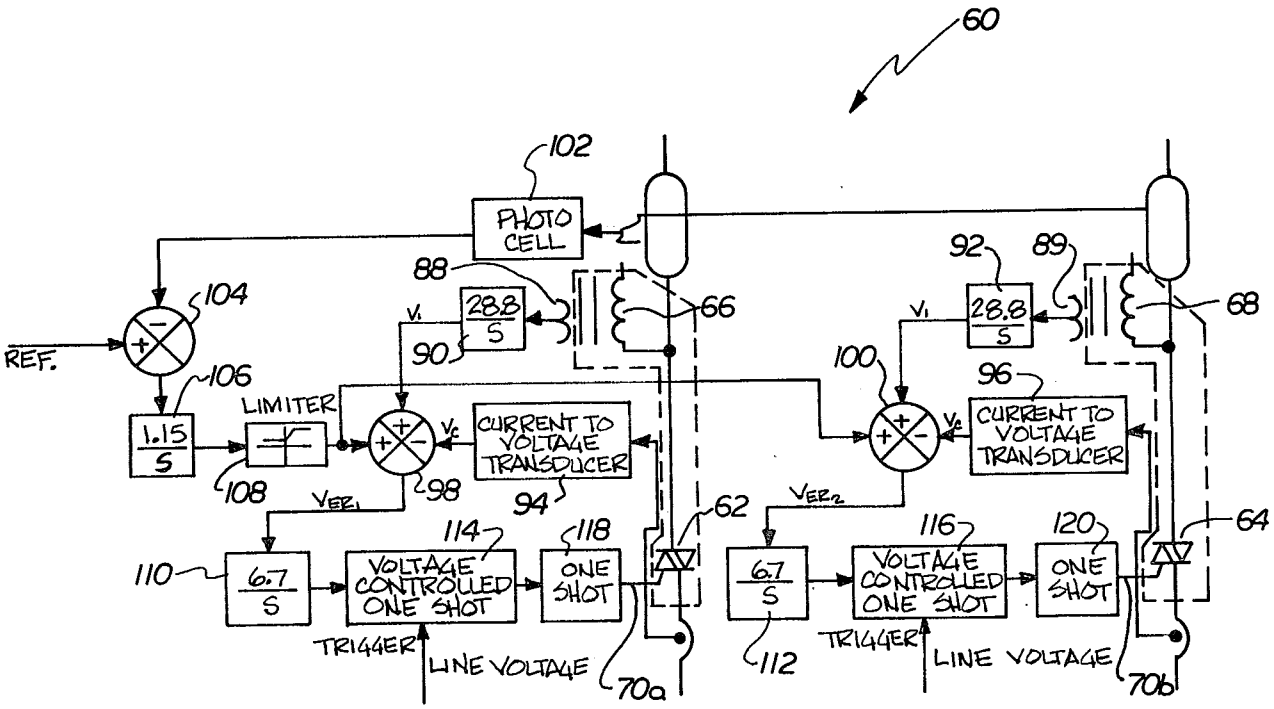
FIG. 7 illustrates, in block diagram format, the control circuit of the present invention.

Referring to FIG. 7, there is shown in block diagram format control circuit 60 for current regulated modular lighting control 40 or 40'. The portions of FIG. 7 enclosed in dashed line boxes are not part of the control circuit but are the controlled impedances (TRIACS) and the circulating inductors.

Broadly stated, the control scheme consists of two feedback loops for each ballast, a first loop controlling lamp current within the boundaries of a limiter, and a second loop controlling lighting intensity. The first loop sets lamp current to a specific value. Lamp current is monitored by sampling the current through each TRIAC 62 and 64 and the voltage across secondary windings 88 and 89 of circulating inductors 66 and 68. The voltage across windings 66 and 68 are separately integrated by integration means 90 and 92 to produce voltages directly proportional to the inductor currents. Each of these integrated voltages $V_1$ are subtracted from the voltage produced by current-to-voltage transducers 94 and 96. The result is voltages $V_c$ which are respectively proportional to current monitored at one terminal of each controlled impedance 62 and 64. The subtraction of the voltage $V_1$ from $V_c$ by each summing means 98 and 100 produces independent signals which are a direct function of the lamp current, the parameter used in current regulation by the circuitry.

The second feedback loop compares the output signal of a photocell 102 to a reference signal. As illustrated in the figure, photocell 102 is positioned to intercept a portion of the irradiance for each gas discharge lamp, producing a signal which is proportional to the output illumination level of the lamp and some ambient level. Comparator means 104 compares the output of the photocell to a reference signal, $V_{reference}$. This reference signal may be established internally to the unit or by an external voltage reference circuit (not shown). The output of comparator 104 is connected to an integrator 106, which functions to attenuate responses caused by ambient lighting perturbations or the like. The output of the integrator means is coupled to a signal limiter 108, which restricts the signal to boundaries within the dynamic range of a given lamp configuration.

The output of signal limiter 108 is connected to summing means 98 and 100 and thus combines the signals of the first feedback loop. The resultant signals from summing means 98 and 100 are independent differential signals $V_{error1}$ and $V_{error2}$. The differential signals are coupled to integrator means 110 and 112, which integrate the differential signals with respect to time. These signals are in turn coupled to the inputs of voltage controlled one-shot means 114 and 116 and one-shots 118 and 120 which control the firing of TRIACS 62 and 64. The outputs of integrators 110 and 112 advance the timing of the voltage controlled one-shot means, which in turn advances the firing of controlled impedances 62 and 64.

The operation of the control circuitry can be best illustrated by assuming that there is a positive error, $+V_{error(1\ or\ 2)}$, between the set point and the lamp current. The positive error causes the output of one integrator 110 or 112 to increase with time, which advances the timing of the voltage controlled one-shot. This in turn causes TRIAC 62 or 64 to trigger earlier in the voltage cycle, increasing the current fed to lamps 12 and 13 or 14 and 15. When the differential signal from summing means 98 or 100 approaches zero ($V_{error}0$), the signal from integrator means 110 or 112 ceases increasing, and the timing of the TRIAC firing during the voltage cycle remains unchanged.

Although illustrated heretofore as a four lamp configuration, the present invention circuitry may be applied to two, or more than four, gas discharge lamp configurations. Each two lamp configuration includes a ballast substantially similar to that illustrated in FIGS. 5 or 6 requiring a circulating inductor, controlled impedance, and control circuit for each ballast configuration.

Figure 8:
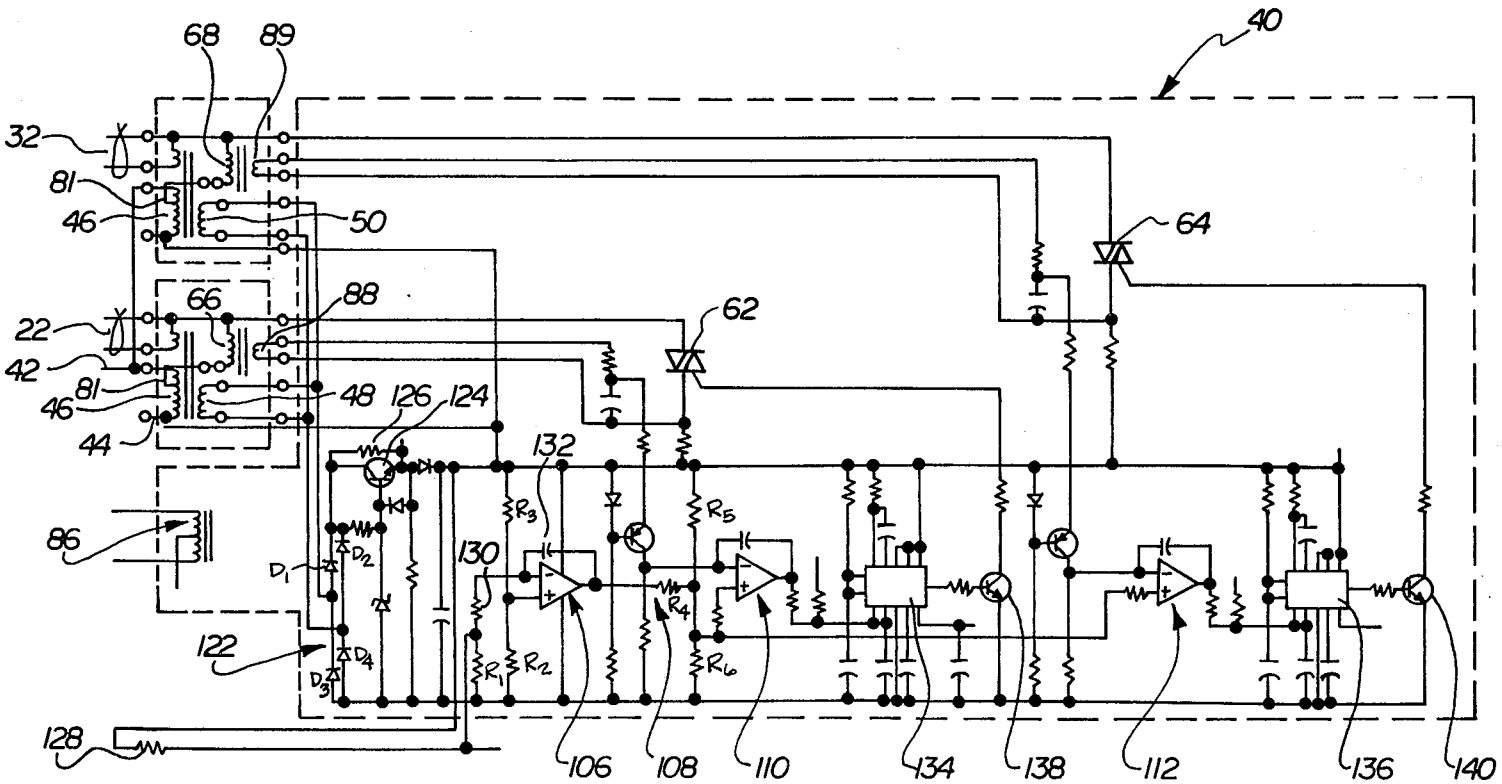
FIG. 8 illustrates a specific embodiment of the invention.

To assist one skilled in the art in the practice of the present invention, FIG. 8 illustrates a circuit diagram for a specific embodiment with four fluorescent lamp configuration for the modular lighting control with circulating inductors. The controlled impedances comprise TRIACS 62 and 64 having their main current conduction paths coupled between gas discharge lamp lead pairs 22 and 32 and one of ballast input lead pairs 82' and 84'. Circulating inductors 66 and 68 are coupled between gas discharge lamp lead pairs 22 and 32 and one terminal of TRIACS 62 and 64.

A diode bridge 122, including diodes $D_1$ through $D_4$, provides rectified power for the control circuit and 60 Hertz synchronization for the one-shots, discussed hereinafter. Transistor 124 and resistor 126 comprise a series regulator maintaining a given voltage for the control circuit supply, typically about 10 volts. A photocell 128 is placed in a bridge configuration with resistors $R_1$, $R_2$ and $R_3$. The reference for the bridge configuration may be set mechanically with a shutter mechanism covering the photocell from irradiation by the lamps or electronically by adjusting the bridge resistors themselves.

Resistor 130 and capacitor 132 form integrator 106 used in the second control loop. The output signal of the integrator is applied to a resistive network comprising resistors $R_4$, $R_5$ and $R_6$. This resistor network comprises signal limiter 108, the boundaries of which are set by the value of resistors $R_5$ and $R_4$ for the lower and upper boundaries, respectively. The output of the limiter is compared to the voltages representing half cycle lamp currents, the measurements of which have been detailed heretofore. The differences are integrated at 110 and 112 and applied to timing networks each of which include two resistors and a capacitor. Integrated circuits 134 and 136 comprise dual timers arranged in two one-shot configurations each. The first one-shot configuration is triggered by the zero crossing of line voltage; the second by the trailing edge of the first. The outputs of second one-shots are coupled to the bases of transistors 138 and 140, the outputs of which are used to trigger TRIACS 62 and 64.

What is claimed is:

1. An apparatus for controlling output illumination level of gas discharge lamps comprising:

a source of AC voltage;

multiple ballast means for providing operating electrical current to said lamps, each said ballast means coupled in series relationship with at least one said gas discharge lamp;

a controlled impedance coupled between an output of each said ballast means and at least one lamp;

means for controlling a period of conduction of each said controlled impedance;

an isolation transformer, having a primary winding coupled between a neutral and a power supplying terminal of each said ballast means, a voltage tap on said primary winding, and a secondary winding coupled to a cathode of said lamps; and an inductor coupled in parallel relationship with each said controlled impedance providing a current path between said voltage tap and said discharge lamps at least when each said impedance is non-conducting.

2. An apparatus for providing load side control of output illumination levels of gas discharge lamps comprising:

a source of AC power;

multiple ballast means for providing operating electrical current to said lamps, each said ballast means coupled in series relationship with at least one said gas discharge lamp;

a controlled impedance coupled between an output of each said ballast means and said at least one gas discharge lamp;

means for controlling a period of conduction of said controlled impedances, said means being responsive to a signal comprising deviation of lamp current from a reference value; and an inductor coupled in parallel relationship with each said controlled impedance providing a current path between said power source and the lamps at least whenever said impedances are substantially non-conducting, each said inductor having a secondary winding coupled to a means for detecting lamp current.

3. The apparatus of claim 2 wherein each said controlled impedance comprises a TRIAC.

4. The apparatus of claim 3 wherein a current detection means is coupled to one load terminal of each said TRIAC.

5. The apparatus of claim 4 wherein said current detected at the load terminal of each said TRIAC and the current detected in the secondary of each said inductor are coupled to summing means for providing a current regulation signal used to regulate lamp current.

6. An apparatus for providing load side control of output illumination level of gas discharge lamps while maintaining low lamp current crest factor and increased power factor, said apparatus comprising:

a source of AC power;

multiple ballast means for providing operating electrical current to said lamps, each said ballast means coupled in series relationship with at least one said gas discharge lamp;

an input capacitance of less than about six microfarads; a control circuit comprising a first and second control loop arrangement, said first control loop functioning to control lamp current within boundaries of a limiter, said second control loop functioning to compare a signal proportional to said lamp illumination level to a reference signal, and further to provide or deny a drive signal;

multiple TRIACS each having a main current conduction path coupled between an output of one said ballast means and at least one of said gas discharge lamps, each said TRIAC being responsive to said drive signal to provide current conduction between one said ballast and at least one of said lamps during at least a portion of each AC voltage half-cycle; and an inductor coupled in parallel relationship with each said TRIAC providing a current path between said power source and said at least one gas discharge lamp at least whenever said TRIAC is substantially non-conducting.

* * * * *